US008746693B2

(12) United States Patent
Miyazawa

(10) Patent No.: US 8,746,693 B2
(45) Date of Patent: Jun. 10, 2014

(54) IMAGE FORMING APPARATUS

(71) Applicant: Canon Kabushiki Kaisha, Tokyo (JP)

(72) Inventor: Hideaki Miyazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 13/658,011

(22) Filed: Oct. 23, 2012

(65) Prior Publication Data

US 2013/0113158 A1 May 9, 2013

(30) Foreign Application Priority Data

Nov. 7, 2011 (JP) ..... 2011-243446

(51) Int. Cl.
*B65H 9/16* (2006.01)

(52) U.S. Cl.
USPC ..... 271/251; 271/248; 271/249; 271/227

(58) Field of Classification Search
USPC ..... 271/248, 249, 250, 251, 253, 254, 226, 271/227
See application file for complete search history.

(56) References Cited

U.S. PATENT DOCUMENTS 4,426,073 A * 1/1984 Mizuma ..... 271/251
5,226,643 A * 7/1993 Kriegel et al. ..... 271/250
5,253,862 A 10/1993 Acquaviva et al.
6,273,418 B1 8/2001 Fujikura et al.
6,789,794 B2 9/2004 Miyazawa
7,404,557 B2 * 7/2008 Tada et al. ..... 271/226
7,571,908 B2 * 8/2009 Inui et al. ..... 271/251
7,637,499 B2 * 12/2009 Kawashima et al. ..... 271/240
7,641,191 B2 * 1/2010 Inui ..... 271/251
7,658,379 B2 * 2/2010 Yasumoto ..... 271/251
7,900,914 B2 * 3/2011 Fujita et al. ..... 271/251
8,002,272 B2 8/2011 Miyazawa
8,123,218 B2 * 2/2012 Yasumoto ..... 271/251
8,205,878 B2 * 6/2012 Masuda ..... 271/249
8,205,879 B2 * 6/2012 Fujita et al. ..... 271/251
8,308,160 B2 11/2012 Miyazawa
8,366,104 B2 * 2/2013 Sato et al. ..... 271/236
8,447,223 B2 * 5/2013 Inui ..... 399/401
2010/0296854 A1 * 11/2010 Otsuki et al. ..... 400/582
2011/0260395 A1 10/2011 Miyazawa
2012/0091653 A1 4/2012 Miyazawa

* cited by examiner

*Primary Examiner* — Ernesto Suarez
(74) *Attorney, Agent, or Firm* — Fitzpatrick, Cella, Harper & Scinto

(57) ABSTRACT

A reference member which regulates a position of one side end of a sheet along the sheet conveying direction is provided at one side of a sheet conveying path in the width direction so as to follow the sheet conveying direction and to be rotatable about its downstream end portion in the sheet conveying direction. Then, one side end of the sheet is skew-conveyed toward the reference member by a plurality of pair of skew-conveying rollers which is arranged in the sheet conveying path along the sheet conveying direction. Then, when forming an image on both faces of the sheet, a control portion rotates the reference member so that the sheet is displaced to the center side in the sheet conveying path compared to the case of forming an image on one face of the sheet.

4 Claims, 19 Drawing Sheets

*FIG. 15B*

| INPUT PULSE | ROTATION ANGLE γ [°] | CAM INGRESSION AMOUNT λ [mm] | SKEW-FEEDING ADJUSTMENT AMOUNT α [mm]/A3 |
|---|---|---|---|
| 0 | 82.5 | 0.462 | 1.1 |
| 2 | 78.75 | 0.441 | 1.05 |
| 4 | 75 | 0.42 | 1 |
| 6 | 71.25 | 0.399 | 0.95 |
| 8 | 67.5 | 0.378 | 0.9 |
| 10 | 63.75 | 0.357 | 0.85 |
| 12 | 60 | 0.336 | 0.8 |
| 14 | 56.25 | 0.315 | 0.75 |
| 16 | 52.5 | 0.294 | 0.7 |
| 18 | 48.75 | 0.273 | 0.65 |
| 20 | 45 | 0.252 | 0.6 |
| 22 | 41.25 | 0.231 | 0.55 |
| 24 | 37.5 | 0.21 | 0.5 |
| 26 | 33.75 | 0.189 | 0.45 |
| 28 | 30 | 0.168 | 0.4 |
| 30 | 26.25 | 0.147 | 0.35 |
| 32 | 22.5 | 0.126 | 0.3 |
| 34 | 18.75 | 0.105 | 0.25 |
| 36 | 15 | 0.084 | 0.2 |
| 38 | 11.25 | 0.063 | 0.15 |
| 40 | 7.5 | 0.042 | 0.1 |
| 42 | 3.75 | 0.021 | 0.05 |
| 44 | 0 | 0 | 0 |

IMAGE FORMING APPARATUS

BACKGROUND OF THE INVENTION

1. Field of the Invention

The present invention relates to an image forming apparatus, and particularly, to an image forming apparatus having a configuration that corrects skew-feeding of a sheet and a position of a sheet in the width direction.

2. Description of the Related Art

Hitherto, image forming apparatuses such as copying machines, printers, and facsimiles are equipped with a sheet conveying apparatus that conveys a sheet to an image forming portion. Here, when skew-feeding or displacement in a position (transverse registration position) in the width direction perpendicular to the sheet conveying direction occurs in the sheet in conveying the sheet toward the image forming portion, an image is formed on the sheet while the image position is displaced. Therefore, in the sheet conveying apparatus of the related art, a skew-feeding correcting portion which corrects the skew-feeding of the sheet and aligns the transverse registration position is provided at the upstream side of the image forming portion in the sheet conveying direction. As an example of the skew-feeding correcting portion, there is proposed a skew-feeding correcting portion which corrects a displacement in a position of a side end of a sheet during a conveying operation based on a side registration (see U.S. Pat. No. 6,273,418).

In the skew-feeding correcting portion which aligns the sheet based on the side registration, a reference member with which one side end of the sheet collides is provided along the sheet conveying direction at one side of the sheet conveying path, and a plurality of skew-conveying rollers is arranged on the sheet conveying path. Then, the sheet which is conveyed by the sheet conveying roller provided at the upstream side in the sheet conveying direction is skew-conveyed by the skew-conveying roller toward the reference member, and one side end of the sheet collides with the reference member, so that the displacement in the width direction and the inclination of the side end of the sheet are both corrected.

Here, in the skew-feeding correcting portion which uses the skew-conveying roller, if the sheet pressing force against the reference surface (the transverse approaching force by the skew-conveying roller) is too strong when the side end of the sheet collides with the reference surface of the reference member, the sheet is warped, thereby leading to a paper jam or degradation in correction precision in the sheet. For this reason, in the skew-feeding correcting portions of the related art, there is also proposed a skew-feeding correcting portion which moves a side end of a sheet along a reference surface without causing any warpage in the sheet by adjusting a force of pressing the side end of the sheet against the reference surface with a change in the nipping pressure of a skew-conveying roller (see U.S. Pat. No. 5,253,862).

Here, in the image forming apparatus with the skew-feeding correcting portion of the related art, the force of pressing the side end of the sheet against the reference surface can be adjusted, but when the stiffness of the sheet is low, the skew-feeding correction may not be performed with high precision just by the adjustment of the pressing force. For example, in a case where the sheet is a super-thin sheet (a coated sheet having a basis weight which is less than 70 gsm), the stiffness of the sheet is low. Further, in a hot and humid environment, the stiffness of the sheet is degraded.

In general, since the thin coated sheet is easily wound around the fixing roller in the fixing portion to thereby cause a jam, the winding around the fixing roller is prevented by passing the sheet S so that the fiber-orientation direction is parallel to the sheet conveying direction as illustrated in FIG. 18A. Furthermore, the fiber-orientation direction indicates a direction of the fiber of the sheet, and the stiffness of the sheet or the easy occurrence of the curl is different in the fiber-orientation direction. When the sheet is conveyed in the fiber-orientation direction in this way, in a case of a duplex mode, the sheet passing through the fixing portion and having an image formed on both faces follows the fiber-orientation, that is, the sheet is curled in parallel to the sheet conveying direction. Then, when the curl (hereinafter, referred to as a gutter-shaped curl) parallel to the sheet conveying direction occurs in the sheet S, the stiffness of the sheet S in the width direction is degraded.

For this reason, as illustrated in FIG. 18B, when the sheet S having an image formed on both faces collides with a reference member 31 by pairs of skew-conveying rollers 32*a* to 32*c*, the sheet S may be warped in the collision direction. In this case, the skew-feeding correction precision is degraded compared to the case of forming an image on one face of the sheet. That is, in a case of a super-thin coated sheet, the side end position changes by the warpage amount of the sheet between a case of forming an image on a first face and a case of forming an image on a second face. For this reason, even when the sheet collides with the same reference surface, the positions of the front and rear faces in the width direction may not match each other. As a result, when an image is formed on both faces of the sheet, the image forming positions of both faces of the sheet are displaced in the width direction, so that the image quality is degraded.

Therefore, the invention is made in view of these circumstances, and it is desirable to provide an image forming apparatus capable of suppressing a displacement between image forming positions of both faces of a sheet in the width direction even in a sheet having a low stiffness.

SUMMARY OF THE INVENTION

According to an aspect of the invention, there is provided an image forming apparatus which forms an image on a sheet by an image forming portion, and forms the image on the sheet by the image forming portion again after reversing the sheet having the image formed on a first face of the sheet so as to form an image on a second face of the sheet, the image forming apparatus comprising: a sheet conveying path which guides the sheet to the image forming portion so that a center of the sheet in a width direction follows a center of the sheet conveying path; a reference member which is disposed along a sheet conveying direction of the sheet conveying path, is provided so as to be rotatable about a downstream end portion of the sheet conveying direction; a plurality of skew-conveying rollers which is arranged in the sheet conveying path along the sheet conveying direction and obliquely convey the sheet toward the reference member to abut one side end of the sheet to the reference member so as to regulate a position of the sheet in the width direction; a driving portion which rotates the reference member; and a control portion which controls the driving portion so as to rotate the reference member so that an upstream side of the reference member comes close to the center of the sheet conveying path from a position at where the reference member regulates the position of the sheet to form the image on the first face when the reference member regulates the sheet to be formed the image on the second face by the image forming portion.

As in the aspect of the invention, when forming an image on both faces of the sheet, the reference member is further rotated toward the sheet conveying path compared to the case of forming an image on one face of the sheet. Accordingly, even in a sheet having a low stiffness, it is possible to reduce the displacement between the image forming positions of both faces of the sheet in the width direction.

Further features of the present invention will become apparent from the following description of exemplary embodiments with reference to the attached drawings.

BRIEF DESCRIPTION OF THE DRAWINGS

FIGS. 15A and 15B are diagrams illustrating a skew-feeding adjusting direction of the skew-feeding correcting apparatus.

DESCRIPTION OF THE EMBODIMENTS

Figure 1:
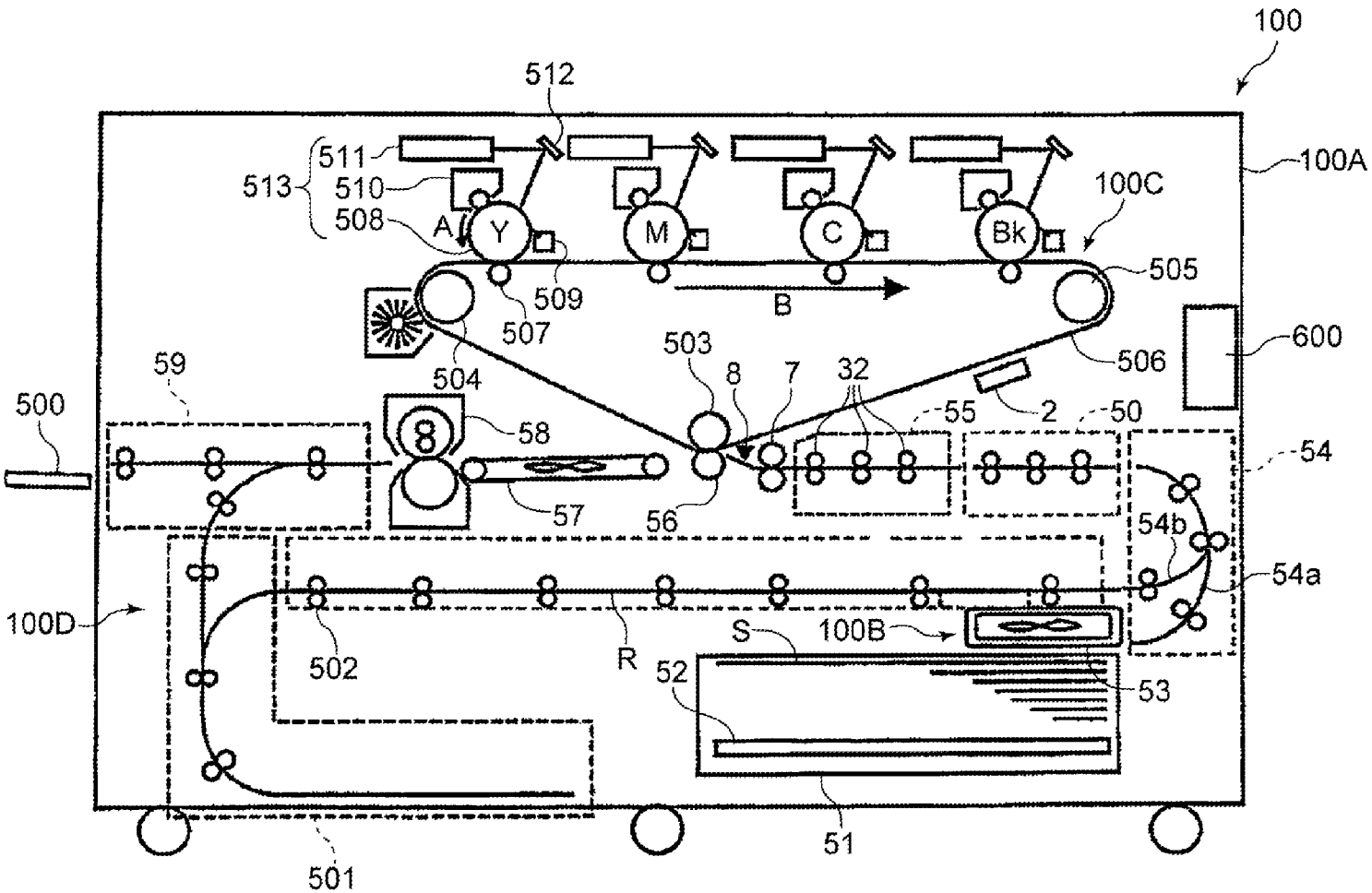
FIG. 1 is a diagram illustrating a schematic configuration of a color image forming apparatus which is an example of an image forming apparatus according to an embodiment of the invention.

Hereinafter, exemplary embodiments of the invention will be described in detail by referring to the drawings. FIG. 1 is a diagram illustrating a schematic configuration of a color image forming apparatus which is an example of an image forming apparatus according to an embodiment of the invention. In FIG. 1, a color image forming apparatus 100 is provided, and a color image forming apparatus body 100A (hereinafter, referred to as an apparatus body) is provided. Furthermore, based on the configuration, the color image forming apparatus 100 is mainly classified into a tandem type in which a plurality of image forming portions is arranged in parallel and a rotary type in which a plurality of image forming portions is arranged in a cylindrical shape. Further, the transfer type is classified into a direct transfer type in which a toner image is directly transferred from a photosensitive drum to a sheet and an intermediate transfer type in which a toner image is first transferred to an intermediate transfer member and is transferred to a sheet. Here, the intermediate transfer type may handle various kinds of sheets such as a super-thick cardboard or a coated sheet since there is no need to hold a sheet on a transfer belt as in the direct transfer type. Further, the intermediate transfer type may appropriately realize the high productivity due to the features of a parallel process and a batch transfer of a full color image in the plurality of image forming portions. Then, the color image forming apparatus 100 according to the embodiment is of an intermediate transfer tandem type in which four colors of image forming units are arranged in parallel on the intermediate transfer belt.

The apparatus body 100A is equipped with an image forming portion 513, a sheet feeding portion 100B which conveys a sheet S, and a transfer portion 100C which transfers a toner image formed by the image forming portion 513 to the sheet S fed by the sheet feeding portion 100B. Further, the apparatus body 100A is equipped with a sheet conveying apparatus 100D which conveys a sheet. Here, the image forming portion 513 includes image forming units of yellow (Y), magenta (M), cyan (C), and black (Bk) each of which includes a photosensitive drum 508, an exposure unit 511, a developing unit 510, a primary transfer unit 507, a cleaner 509, and the like. Furthermore, the colors which are formed by the respective image forming units are not limited to these four colors, and the arrangement order of the colors is also not limited thereto.

The sheet feeding portion 100B includes a sheet accommodating portion 51 which accommodates the sheets S so as to be stacked on a lift-up apparatus 52 and a sheet feeding unit 53 which sends the sheets S accommodated in the sheet accommodating portion 51. Furthermore, as the sheet feeding unit 53, a type which uses the friction-separation of the sheet feeding roller and the like or a type which uses the separation-absorption of air may be exemplified, but in the embodiment, a sheet feeding type using air is exemplified. Further, the transfer portion 100C includes an intermediate transfer belt 506 which is suspended on rollers such as a driving roller 504, a tension roller 505, and a secondary inner transfer roller 503 and is driven so as to be conveyed in the direction of the arrow B in the drawings.

Here, a toner image which is formed on the photosensitive drum is transferred to the intermediate transfer belt 506 by a predetermined pressure and an electrostatic load bias given by the primary transfer unit 507. Further, the intermediate transfer belt 506 allows an unfixed image to be absorbed to the sheet S by giving a predetermined pressure and an electrostatic load bias to the sheet S at a secondary transfer portion which is formed by a secondary inner transfer roller 503 and a secondary outer transfer roller 56 that substantially face each other. The sheet conveying apparatus 100D includes a conveying unit 54, a conveying roller apparatus 50 constituting a conveying roller portion, a skew-feeding correcting apparatus 55 constituting a skew-feeding correcting portion, a registration roller 7, a pre-fixing conveying portion 57, a branch conveying apparatus 59, a reverse conveying apparatus 501, a double-sided conveying apparatus 502, and the like. Furthermore, in FIG. 1, a controller 600 which serves as a control unit is provided so as to control the image forming operation of the color image forming apparatus 100 and the skew-feeding correcting operation of the sheet.

Then, when forming an image in the color image forming apparatus 100 with such a configuration, first, the photosensitive drum 508 is rotated in the direction of the arrow A in the drawings so as to evenly charge the surface of the photosensitive drum by a charging portion (not illustrated) in advance. Subsequently, the exposure unit 511 generates light with respect to the rotating photosensitive drum 508 based on the transmitted image information signal, and appropriately irradiates the light to the photosensitive drum through a reflection portion 512 and the like, thereby forming a latent image on the photosensitive drum 508. Furthermore, the transferred toner remaining on the photosensitive drum 508 is collected by the cleaner 509 and is provided for the next image forming operation again.

Next, the electrostatic latent image formed on the photosensitive drum 508 is developed through toner by the developing unit 510 in this way, so that a toner image is formed on the photosensitive drum. Subsequently, a predetermined pressure and an electrostatic load bias are given by the primary transfer unit 507, so that the toner image is transferred onto the intermediate transfer belt 506. Furthermore, the image forming operations using the respective image forming units of Y, M, C, and Bk of the image forming portion 513 are performed at the timing at which the respective colors are superimposed on the upstream toner image firstly transferred onto the intermediate transfer belt. As a result, a full color toner image is finally formed on the intermediate transfer belt 506.

Further, the sheet S is sent by the sheet feeding unit 53 at the timing at which the image is formed by the image forming portion 513. Subsequently, the sheet S passes a conveying path 54*a* of the conveying unit 54 and is conveyed to the skew-feeding correcting apparatus 55 which corrects the displacement and the skew-feeding of the sheet in the width direction perpendicular to the sheet conveying direction during the conveying operation. Then, the sheet S of which the displacement and the skew-feeding are corrected by the skew-feeding correcting apparatus 55 is conveyed to the registration roller 7, is subjected to a timing correction in the registration roller 7, and is conveyed to the secondary transfer portion which is formed by the secondary inner transfer roller 503 and the secondary outer transfer roller 56. Subsequently, the full color toner image is secondly transferred onto the sheet S at the secondary transfer portion. Next, the sheet S to which the toner image is secondly transferred in this way is conveyed to a fixing unit 58 by the pre-fixing conveying portion 57. Then, the fixing unit 58 adds a predetermined pressure generated by a belt or rollers substantially facing each other and a heating effect generally obtained by a heating source such as a heater to the sheet S, so that the toner image is melt-fixed onto the sheet S.

Next, the sheet S which has a fixed image obtained in this way is directly discharged onto a discharge tray 500 by the branch conveying apparatus 59. Furthermore, when forming an image on both faces of the sheet S, the sheet S is conveyed to the reverse conveying apparatus 501 by the switching of a switching member (not illustrated). Here, when the sheet S is conveyed to the reverse conveying apparatus 501 in this way, the sheet S is switched back so that the leading and tail ends are reversed, and is conveyed to a re-conveying path R as a sheet conveying path that is provided in the double-sided conveying apparatus 502 so as to guide the sheet. Subsequently, the sheet joins to a re-feeding path 54*b* provided in the conveying unit 54 so as to match the timing of the sheet of the subsequent job conveyed from the sheet feeding portion 100B and is sent to the secondary transfer portion again. The description of the image forming process will not be repeated since it is the same as that of the first face of the sheet. Furthermore, the conveying unit 54, the branch conveying apparatus 59, the reverse conveying apparatus 501, and the double-sided conveying apparatus 502 are equipped with a plurality of conveying rollers. Then, in these conveying rollers, the sheet is conveyed in a manner such that a driving roller and a driven roller rotate while the sheet is nipped between the driving roller and the driven roller. Further, in these conveying rollers, a pressure of nipping the sheet between both rollers is set by biasing the driven roller toward the driving roller by a biasing member such as a spring (not illustrated). Furthermore, in the embodiment, a configuration is adopted in which the sheet is conveyed based on the sheet conveying center by aligning the center of the sheet in the width direction to the center of the sheet conveying path in a direction perpendicular to the conveying direction.

Here, in the embodiment, the skew-feeding correcting apparatus 55 which corrects the displacement and the skew-feeding of the sheet during the conveying operation is of a side registration based correction type which corrects the displacement of the sheet based on the side end of the sheet during the conveying operation. For this reason, as illustrated in FIGS. 2A to 2D, the skew-feeding correcting apparatus 55 is equipped with a fixed guide 33 which serves as a conveying guide for the sheet S and a movable guide 30 which is movable in the width direction (the main scanning direction) indicated by the arrow in response to the size of the conveyed sheet S.

Further, the movable guide 30 is equipped with a plurality of pairs of skew-conveying rollers 32*a* to 32*c* which includes driving rollers 332*a* to 332*c* along the sheet conveying path R1 and a collision reference member 31 which is drooped so that the sheet S obliquely sent by the pairs of skew-conveying rollers 32*a* to 32*c* abuts the collision reference member. Furthermore, the driving rollers 332*a* to 332*c* are attached to the movable guide 30 while being inclined by an angle θ with respect to the sheet conveying direction so as to obtain a conveying element colliding with the collision reference member 31 (hereinafter, referred to as a reference member) positioning the side end of the sheet. Further, the reference member 31 is disposed along the sheet conveying direction at one side of the sheet conveying path R1, which guides the sheet to the image forming portion 513, in the width direction.

Further, as illustrated in FIGS. 2A to 2D, a plurality of pairs of conveying rollers 34 is provided in the conveying roller apparatus 50 which is disposed at the upstream of the skew-feeding correcting apparatus 55 in the sheet conveying direction and conveys the sheet to the skew-feeding correcting apparatus 55. Here, as illustrated in FIGS. 3A to 3C, each of the plurality of pairs of conveying rollers 34 includes a rubber-like driving roller 13 which serves as a lower roller and a resinous driven roller 14 which serves as an upper roller that conveys the sheet along with the driving roller 13 while pressing the driving roller 13 in a manner of moving close to or away from the driving roller 13.

Figure 3A:
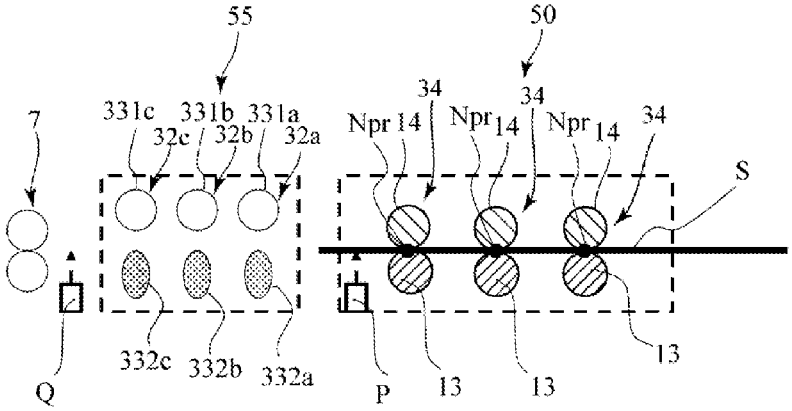
FIGS. 3A to 3C are side views illustrating the configurations of the skew-feeding correcting apparatus and the conveying roller apparatus.
Figure 3B:
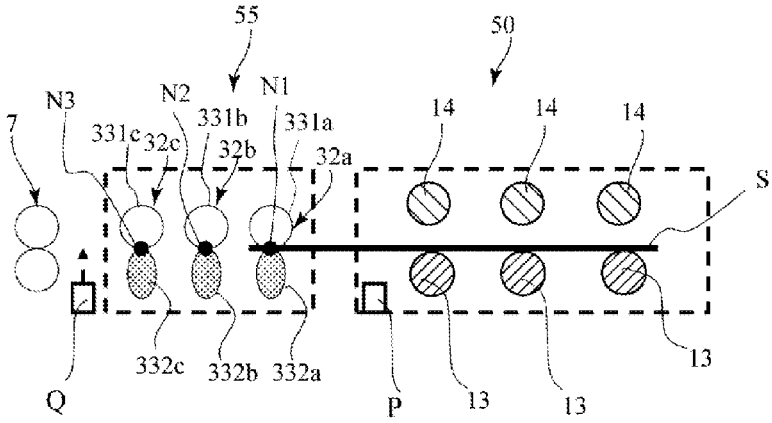
Figure 3C:
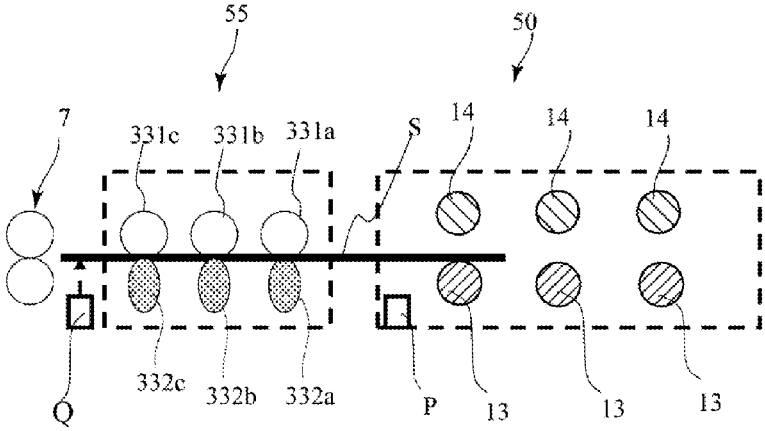

Furthermore, in FIGS. 3A to 3C, a pre-registration sensor P is provided, and the pre-registration sensor P is of an optical type with a light emitting portion and a light receiving portion. When the sheet S passes the sensor, the sheet passing timing is detected by detecting the light reflected from the sheet S through the light receiving portion. Then, when the leading end of the sheet S passes the pre-registration sensor P, the pair of conveying rollers 34 first stops, and a variation in sheet conveying time (sheet-to-sheet distance) is adjusted. Then, after a variation in sheet conveying time (sheet-to-sheet distance) is adjusted, the rotation of the pair of conveying rollers 34 is resumed, and the sheet is conveyed to the skew-feeding correcting apparatus 55. Further, in FIGS. 3A to 3C, a pre-registration sensor Q is provided, and detects the leading end of the sheet that undergoes the correction of the skew-feeding by the skew-feeding correcting apparatus 55.

Figure 4A:
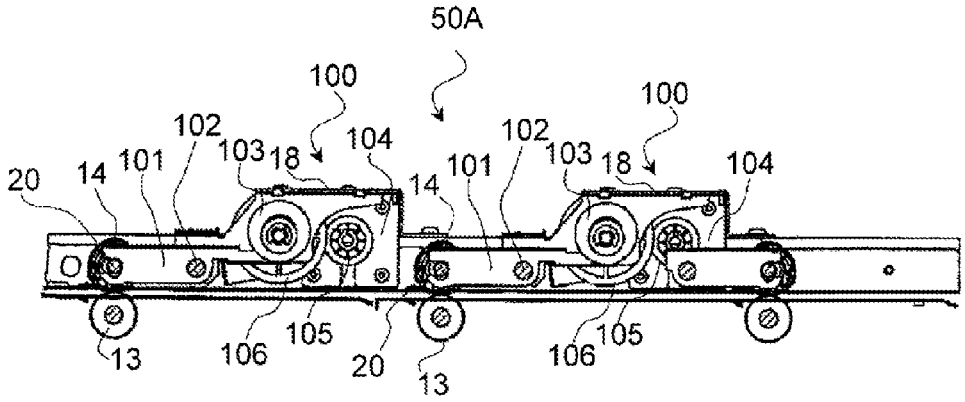
FIGS. 4A and 4B are diagrams illustrating a separating mechanism of a pair of conveying rollers.
Figure 4B:
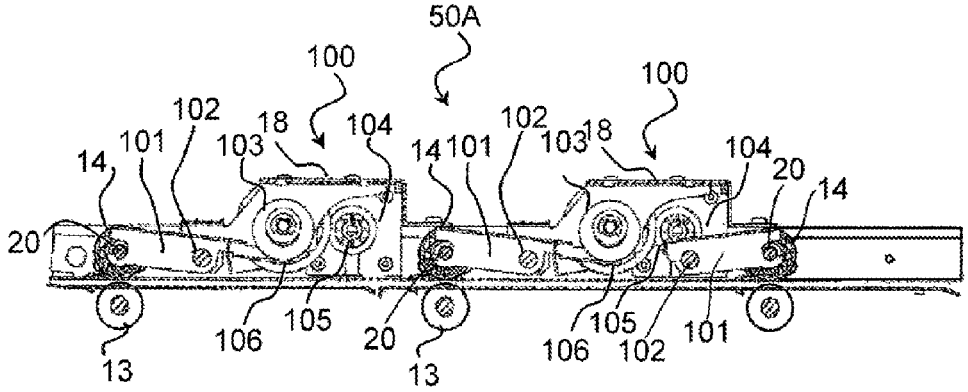

FIGS. 4A and 4B are diagrams illustrating a configuration of a separating mechanism 50A which separates the pair of conveying rollers 34, the driven roller 14 is supported by an arm member 101 through a driven shaft 20 so as to be rotatable, and the arm member 101 is supported by a stay member 18 through a swing shaft 102 so as to be swingable. Then, in a case where the pair of conveying rollers 34 is separated from each other, a pre-registration pressure releasing motor 104 is rotated, and an eccentric roll 103 is rotated through gear sets 105 and 106, so that the end portion of the arm member 101 is pressed by the eccentric roll 103. Accordingly, the arm member 101 which is present at the position illustrated in FIG. 4A rotates about the swing shaft 102 in a nip releasing direction, and the driven roller 14 is lifted as illustrated in FIG. 4B, so that the nip between the driven roller and the driving roller 13 is released. That is, the pair of conveying rollers 34 is separated from each other. Furthermore, in the embodiment, the nip releasing timing is changed by driving the pre-registration pressure releasing motor 104 according to the detection timing of the pre-registration sensor P.

Figure 5:
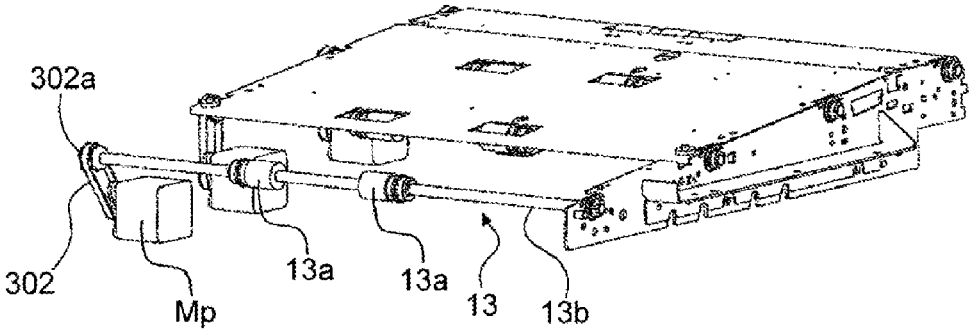
FIG. 5 is a diagram illustrating a driving portion of a driving roller which constitutes the pair of conveying rollers.

FIG. 5 is a diagram illustrating a driving portion of the driving roller 13, and in the driving roller 13, the driving force of a pre-registration driving motor Mp is transmitted to a roller shaft 13*b* having a driving rubber roller 13*a* fixed thereto through a pulley 302*a* and a belt 302. Furthermore, the pre-registration driving motor Mp as a driving portion driving the driving roller 13 is a stepping motor, and the stop timing or the conveying speed is changed according to the timing of the pre-registration sensor P by the pre-registration driving motor Mp.

Then, the driven roller 14 is present at a position where the driven roller presses the driving roller 13 so as to form a nip Npr as illustrated in FIG. 3A when conveying the sheet S conveyed from the conveying unit 54. Accordingly, the sheet S which is conveyed from the conveying unit 54 is nipped between the plurality of pairs of conveying rollers 34 and is conveyed to the skew-feeding correcting apparatus 55 equipped with a plurality of pairs of skew-conveying rollers 32*a* to 32*c*. Furthermore, at this time, the pairs of skew-conveying rollers 32*a* to 32*c* are separated from each other.

Next, at the timing at which the sheet S reaches the first pair of skew-conveying rollers 32*a* on the most upstream side of the skew-feeding correcting apparatus 55 in the sheet conveying direction and but does not reach the second pair of skew-conveying rollers 32*b* on the downstream side yet, the driven roller 14 is separated from the driving roller 13 as illustrated in FIG. 3B. Then, when the driven roller 14 is separated from the driving roller in this way so as to release the nip between the driven roller and the driving roller 13, it is possible to prevent the skew-conveying of the sheet S from being disturbed by the pair of conveying rollers 34 when skew-conveying the sheet S by the pair of skew-conveying rollers 32*a* to 32*c*. Subsequently, the sheets S are obliquely fed in a sequential order by the pair of skew-conveying rollers 32*a* to 32*c* so as to collide with the reference member 31.

Here, as illustrated in FIGS. 3A to 3C, the first to third pairs of skew-conveying rollers 32*a* to 32*c* of the skew-feeding correcting apparatus 55 include the driving rollers 332*a* to 332*c* and the driven rollers 331*a* to 331*c* which convey the sheet S while pressing the driving rollers 332*a* to 332*c* so as to be movable close thereto and away therefrom. Then, as described above, the driving rollers 332*a* to 332*c* are attached to the movable guide 30 while being inclined by an angle θ with respect to the sub-scanning direction. Further, the registration roller 7 also includes a driving roller 7*a* and a driven roller 7*b* which conveys the sheet along with the driving roller 7*a* while pressing the driving roller 7*a* so as to be movable close thereto and away therefrom.

Figure 6:
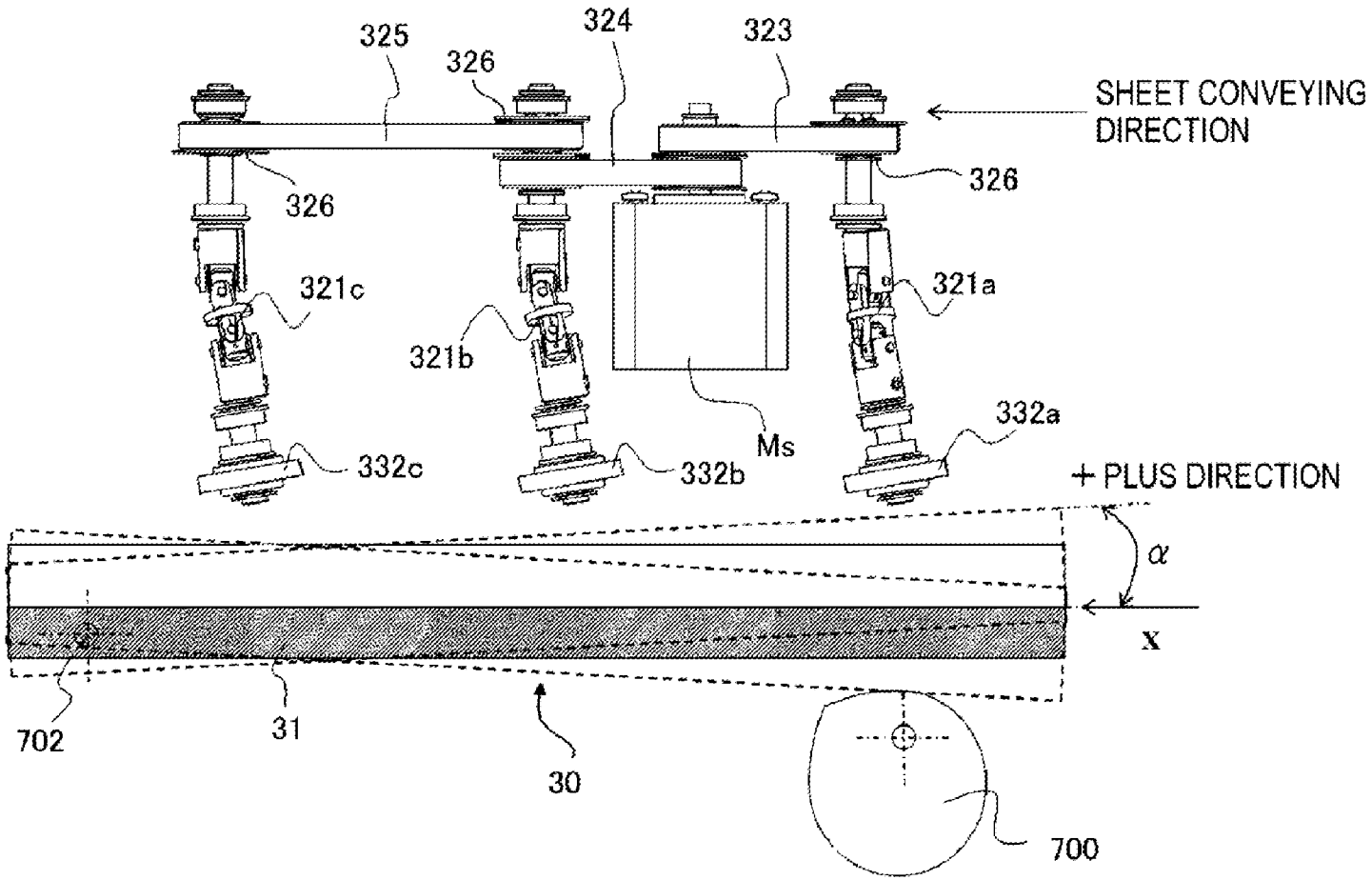
FIG. 6 is a top view illustrating a driving portion which drives a pair of skew-conveying rollers of the skew-feeding correcting apparatus.

FIG. 6 is a top view illustrating a driving portion which drives the driving rollers 332*a* to 332*c* of the first to third pairs of skew-conveying rollers 32*a* to 32*c* provided in the movable guide 30. The first to third driving rollers 332*a* to 332*c* are disposed at an angle θ with respect to the reference member 31, and are driven by the skew-conveying motor Ms through universal joints 321*a* to 321*c*, a pulley 326, and conveying belts 323 to 325. The skew-conveying motor Ms is a stepping motor, the conveying speed may be changed, and the changeable timing may be also set.

Figure 7A:
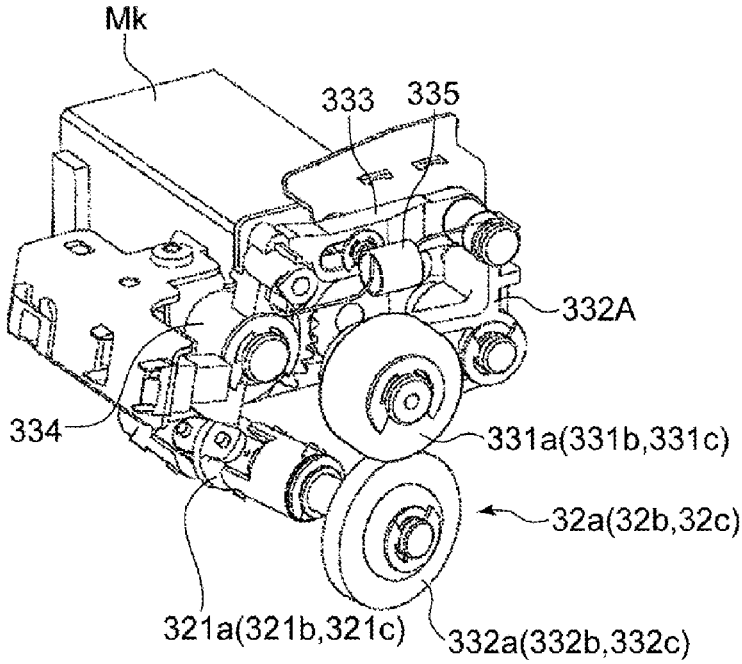
FIGS. 7A and 7B are diagrams illustrating a moving mechanism of a driven roller which constitutes the pair of skew-conveying rollers.
Figure 7B:
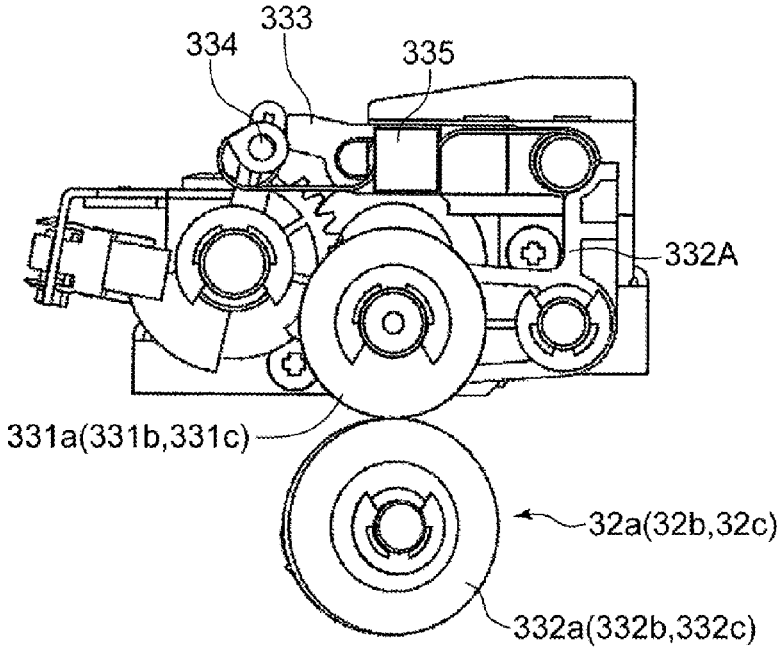

Further, FIGS. 7A and 7B are diagrams illustrating a moving mechanism of the driven rollers 331*a* to 331*c* which are provided so as to be movable close to or away from the driving rollers 332*a* to 332*c* and nip the sheet along with the driving rollers 332*a* to 332*c*. The moving mechanism includes a link 332A which rotatably supports the driven rollers 331*a* to 331*c*, a pressurizing gear 334, a pressurizing spring 335 which is provided between the link 332A and the pressurizing gear 334, and a skew-conveying-pressurizing motor Mk which rotates the pressurizing gear 334. Then, when the pressurizing gear 334 is rotated by a predetermined angle by the skew-conveying-pressurizing motor Mk, the nip pressure (the sheet nipping pressure) between the driven rollers 331*a* to 331*c* and the driving rollers 332*a* to 332*c* is set.

Figure 8A:
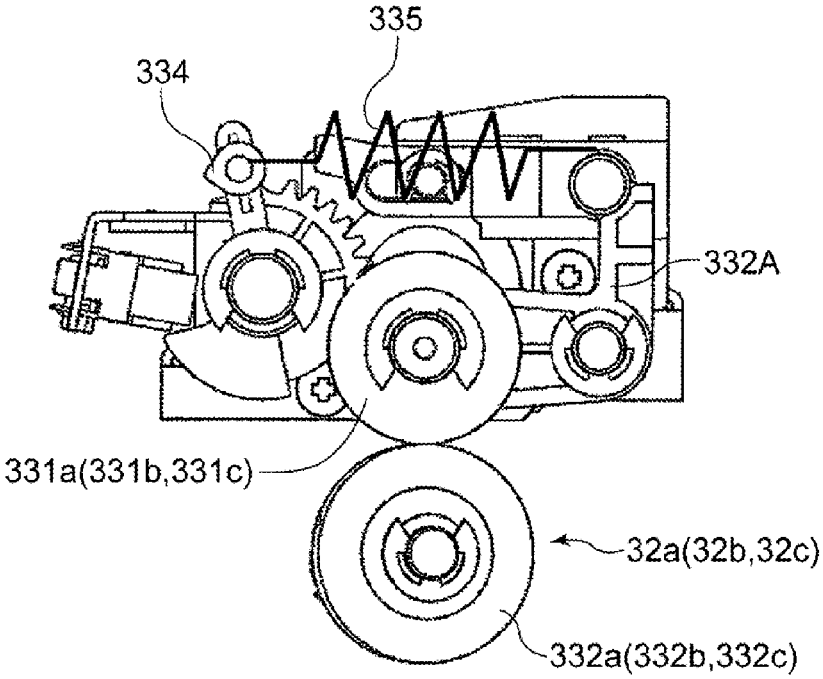
FIGS. 8A and 8B are diagrams illustrating an operation of the moving mechanism of the driven roller.
Figure 8B:
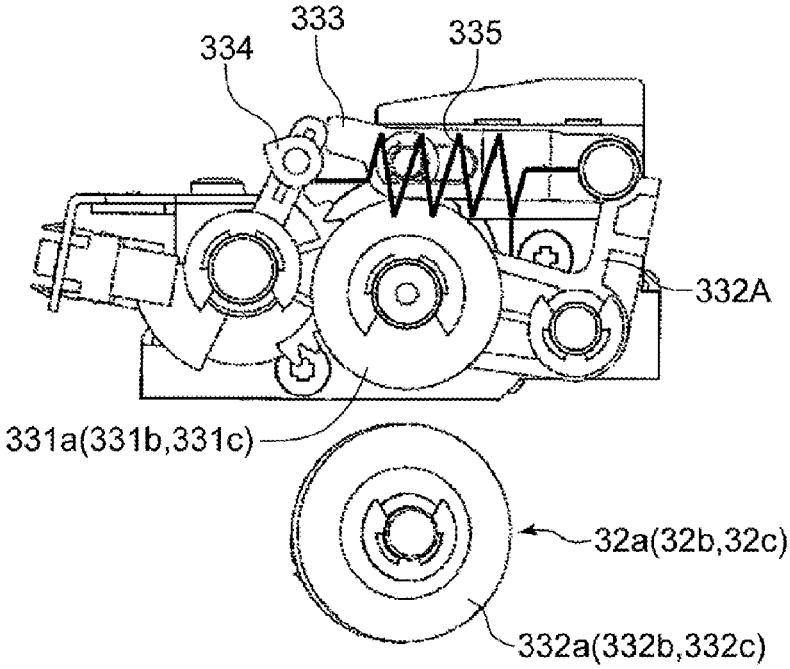

FIG. 8A illustrates a state where the driven rollers 331*a* to 331*c* press the driving rollers 332*a* to 332*c*. At this time, the pressurizing gear 334 rotates leftward and stops while pulling the pressurizing spring 335, and the link 332A is pulled by the pressurizing gear 334 through the pressurizing spring 335. Then, when the link 332A is pulled in this way, the driven rollers 331*a* to 331*c* press the driving rollers 332*a* to 332*c*. Further, FIG. 8B illustrates a nip releasing state, and the pressurizing gear 334 rotates rightward and stops. When the pressurizing gear 334 rotates rightward, the pressurizing gear 334 presses the link 332A through the link 333, and the driven rollers 331*a* to 331*c* move in a nip releasing direction (the upward direction) with the pressing of the link 332A. Furthermore, the skew-conveying-pressurizing motor Mk is a stepping motor, and when the stepping angle is set, the nip pressure of the pair of skew-conveying rollers 32*a* to 32*c* may be changed. Further, in the embodiment, since the moving mechanism is provided in each of the driven rollers 331*a* to 331*c*, the nip pressures of the pair of skew-conveying rollers 32*a* to 32*c* may be independently set.

Figure 2A:
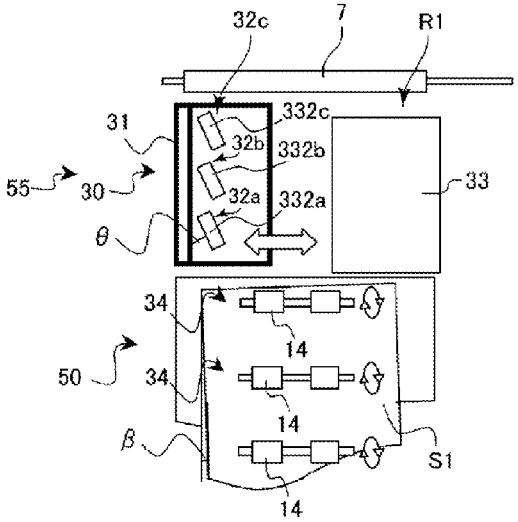
FIGS. 2A to 2D are diagrams illustrating configurations of a skew-feeding correcting apparatus and a conveying roller apparatus installed in a sheet conveying apparatus of the color image forming apparatus.
Figure 2B:
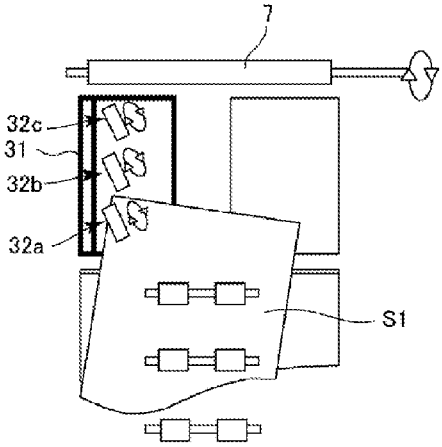

Next, a sheet conveying operation of the conveying roller apparatus 50 and the skew-feeding correcting apparatus 55 with such a configuration will be described. As illustrated in FIG. 2A, when a sheet S1 is conveyed from the conveying unit 54 to the conveying roller apparatus 50 with a skew-feeding angle β, the sheet S1 is sent by the pair of conveying rollers 34 to the skew-feeding correcting apparatus 55. Then, as illustrated in FIG. 2B, the sheet S1 is obliquely conveyed toward the reference member 31 while being nipped between the pair of skew-conveying rollers 32*a* to 32*c*. Furthermore, at the timing at which the sheet S1 reaches the first pair of skew-conveying rollers 32*a* positioned at the most upstream side in the sheet conveying direction and does not reach the second pair of skew-conveying rollers 32*b* which is positioned at the downstream side in the sheet conveying direction in relation to the first pair of skew-conveying rollers 32*a*, the nip between the pair of conveying rollers 34 is released (see FIG. 3B).

Figure 2C:
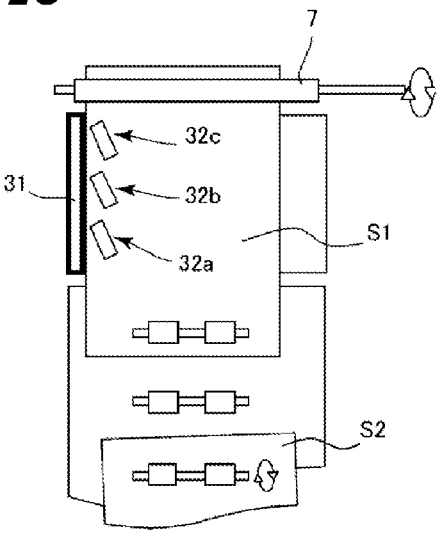

Next, as illustrated in FIG. 2C, the sheet S1 is conveyed by the pair of skew-conveying rollers 32*a* to 32*c* toward the downstream registration roller 7 while the end surface of the sheet S1 is pressed against the reference member 31 constituting the reference surface. Then, when the sheet is conveyed while the end surface is pressed against (abuts) the reference member 31 in this way, the position of one side end of the sheet S1 is regulated and hence the skew-feeding and the displacement in the width direction of the sheet S1 are corrected. Furthermore, in the embodiment, when conveying the sheet S to the skew-feeding correcting apparatus 55 in consideration of a variation in the position of the sheet S1 to be conveyed in the main scanning direction, the reference member 31 is made to wait at a displaced position so as not to collide with the sheet S1 to be conveyed.

Figure 2D:
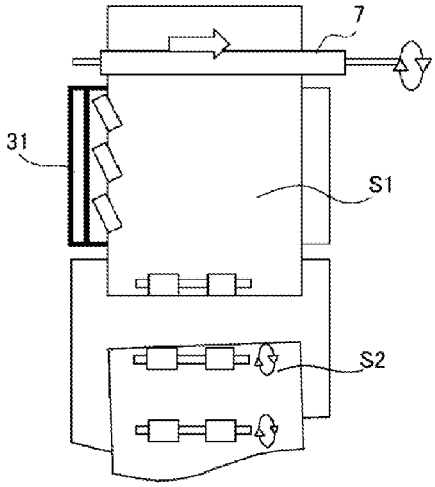

For this reason, when the sheet S1 reaches the registration roller 7 and then the conveying of the sheet S1 is started by the registration roller 7, the registration roller 7 moves in the main scanning direction indicated by the arrow while nipping and conveying the sheet S1 as illustrated in FIG. 2D. Accordingly, the sheet S1 may match the center position of the image on the intermediate transfer belt. Furthermore, the pair of skew-conveying rollers 32*a* to 32*c* are separated from each other before the registration roller 7 moves in the main scanning direction in this way. Accordingly, it is possible to prevent the movement of the sheet S1 with the movement of the registration roller 7 from being disturbed by the pair of skew-conveying rollers 32*a* to 32*c*. Further, after the sheet S1 is delivered to the secondary transfer portion, the registration roller 7 releases the nip and moves in a direction opposite to the arrow illustrated in FIG. 2D so as to return to the standby state for the conveying of the next sheet S2.

Figure 9:
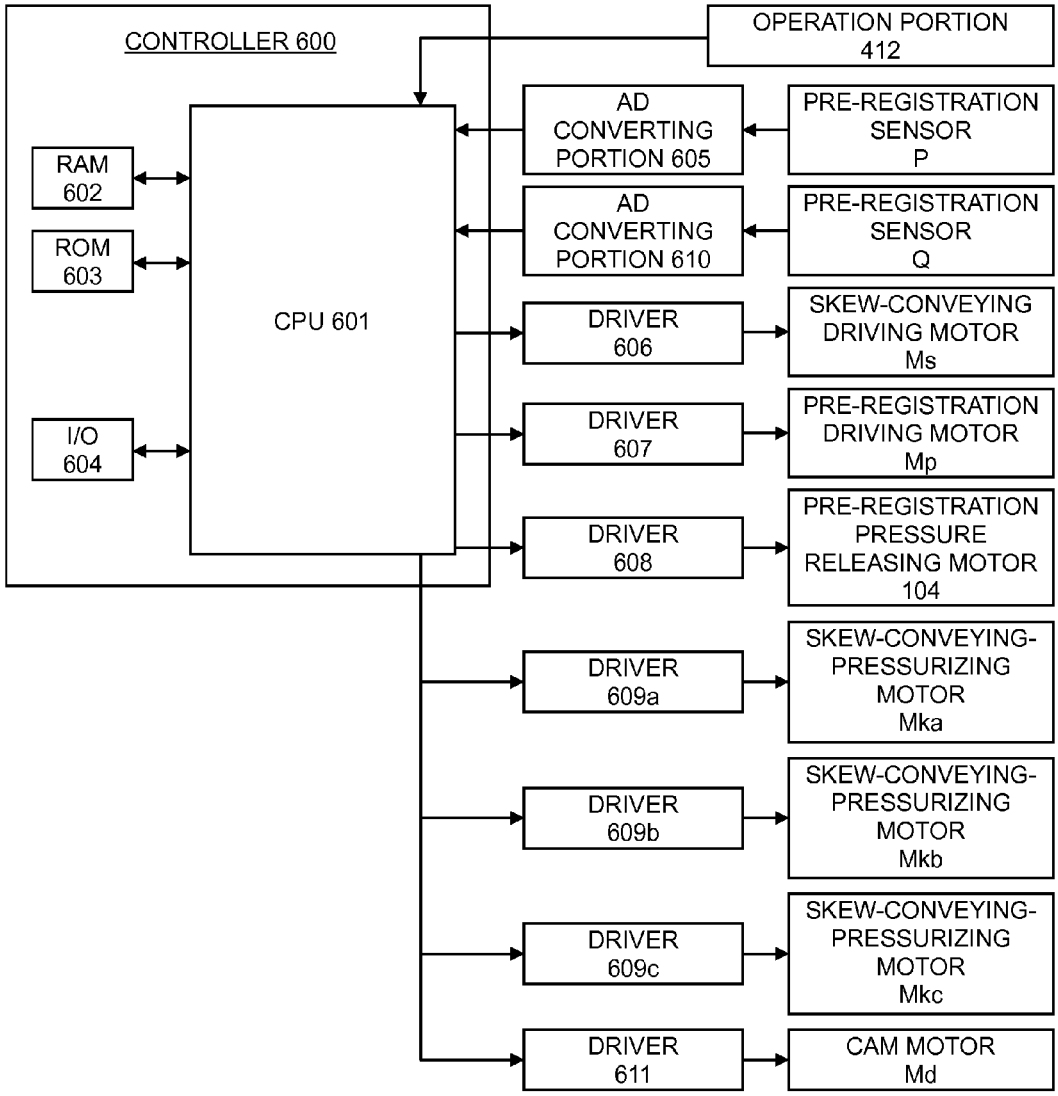
FIG. 9 is a control block diagram illustrating a controller which is installed in the color image forming apparatus.

FIG. 9 is a control block diagram illustrating the controller 600, and the controller 600 includes a CPU 601, a program storage ROM 603, a temporary data storage RAM 602, and a communication I/O 604. Then, when a user inputs information on the size of the sheet S to be used, the basis weight (gsm) thereof, and the number of sheets to be printed from an operation portion 412, the CPU 601 recognizes the size of the sheet S, the basis weight thereof, and the number of sheets to be printed.

Further, the controller 600 controls the driving operations of the skew-conveying motor Ms and the pre-registration driving motor Mp through drivers 606 and 607 in response to the timing signal which may be obtained by the pre-registration sensor P and the pre-registration sensor Q through AD converting portions 605 and 610. Further, the controller 600 controls the driving operations of the pre-registration pressure releasing motor 104 and the skew-conveying-pressurizing motors Mka, Mkb, and Mkc through the drivers 608, 609*a*, 609*b*, and 609*c* in response to the timing signal which may be obtained by the pre-registration sensor P and the pre-registration sensor Q.

Accordingly, the driving operations of the pair of skew-conveying rollers 32*a* to 32*c*, the nip pressures of the driven rollers 331*a* to 331*c* with respect to the driving rollers 332*a* to 332*c*, the driving operation of the driving roller 13, and the releasing operation of the driven roller 14 are controlled. Furthermore, since the driven rollers 331*a* to 331*c* are all independently driven by the skew-conveying-pressurizing motors Mka, Mkb, and Mkc, the nip pressures (the skew-conveying pressures), the nip pressurizing timings, and the nip releasing timings of the driven rollers 331*a* to 331*c* may be independently controlled. Furthermore, in the embodiment, the number of the pairs of skew-conveying rollers 32*a* to 32*c* is three, but the number of the pairs of skew-conveying rollers may be two or more.

In addition, the controller 600 controls the driving operation of a cam motor Md which drives a cam 700 illustrated in FIGS. 6 and 13 through the driver 611. Then, when the driving operation of the cam motor Md is controlled in this way, the collision angles of one-side ends of the sheet having an image formed on one face and the sheet having an image formed on both faces with respect to the reference member 31 in the sheet conveying direction may be changed.

Here, in a case where the sheet S is conveyed to the skew-feeding correcting apparatus 55 in the skew-feeding state as described above, the sheet S is obliquely conveyed toward the reference member 31 by the pair of skew-conveying rollers 32*a* to 32*c*. At this time, the controller 600 calculates and estimates the time during which the first pair of skew-conveying rollers 32*a* nips the sheet based on the detection timing of the pre-registration sensor P, the distance from the pre-registration sensor P to the first pair of skew-conveying rollers 32*a*, and the sheet conveying speed of the conveying roller apparatus 50. Then, when the first pair of skew-conveying rollers 32*a* nips the sheet, the driven roller 14 is separated from the driving roller 13 as illustrated in FIG. 3B so as to release the nipping of the tail end of the sheet.

Figure 10A:
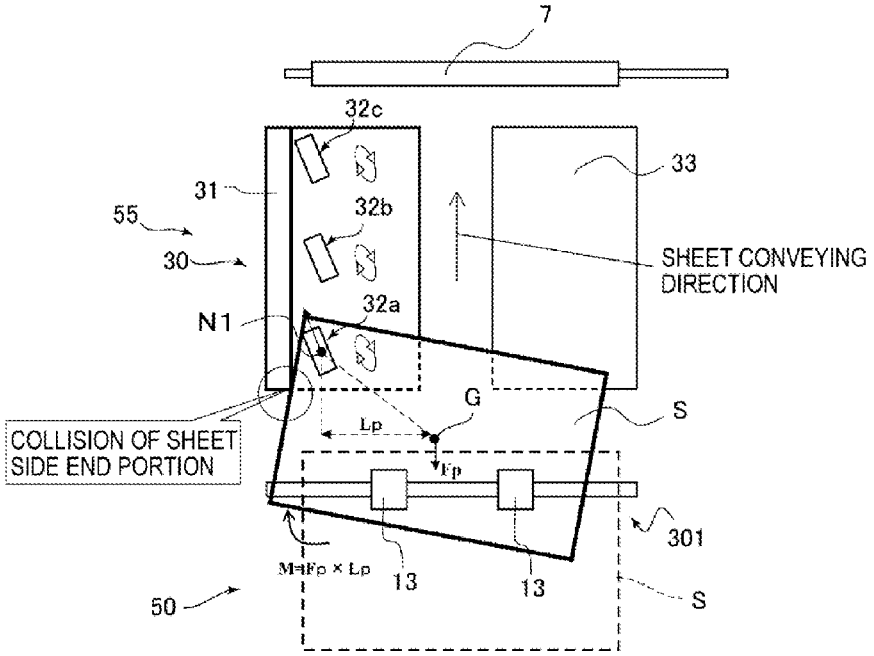
FIGS. 10A and 10B are first diagrams illustrating a movement of a sheet when the skew-feeding correction is performed by the skew-feeding correcting apparatus.

In the skew-feeding correcting apparatus 55 of such a side registration type, the sheet is nipped between the first pair of skew-conveying rollers 32*a* and, at the same time, the driven roller 14 is separated from the driving roller 13 in the related art. Here, on the assumption that the center of the sheet S is indicated by G as illustrated in FIG. 10A, when conveying the sheet S by the first pair of skew-conveying rollers 32*a*, the sheet S receives a force FP in a direction opposite to the sheet conveying direction due to the friction between the surfaces of the movable guide 30 and the fixed guide 33.

Figure 10B:
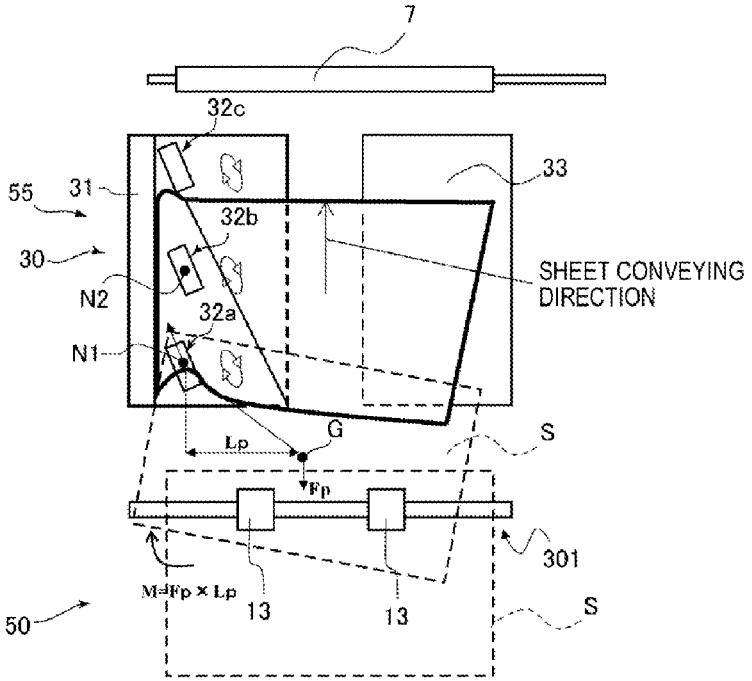

As a result, on the assumption that the distance from the center G to the first pair of skew-conveying rollers 32*a* in the width direction is indicated by Lp, the moment of $M=Fp\times Lp$ is applied to the sheet S. Then, due to the moment M, the side end of the sheet S turns toward the reference member 31 as depicted by the arrow and the side end finally collides with the upstream end of the reference member 31 in the sheet conveying direction. Here, in a case where the sheet S is, for example, a coated sheet having a basis weight of 70 gsm or more, the leading end and the tail end of the sheet S which collides with the reference member 31 are warped as illustrated in FIG. 10B.

Figure 11A:
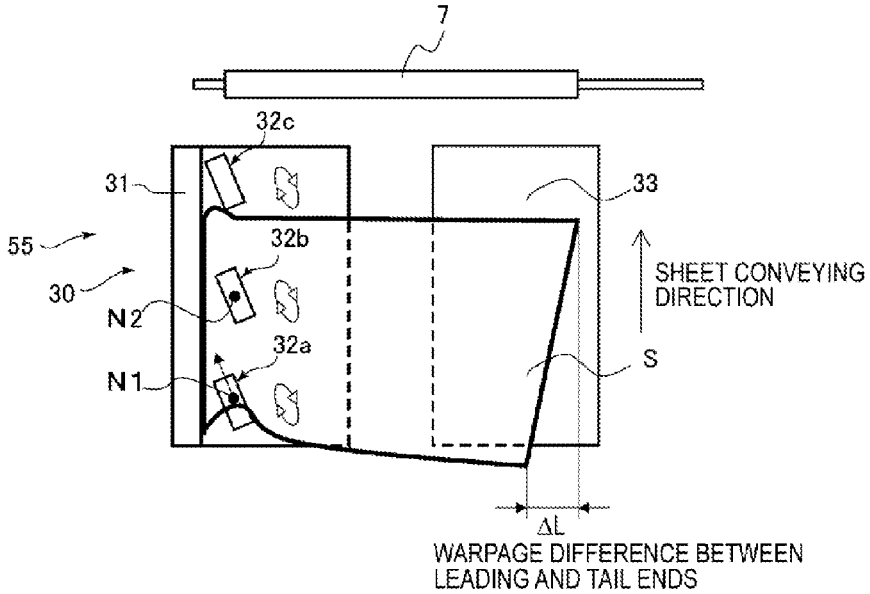
FIGS. 11A and 11B are second diagrams illustrating the movement of the sheet when the skew-feeding correction is performed by the skew-feeding correcting apparatus.
Figure 11B:
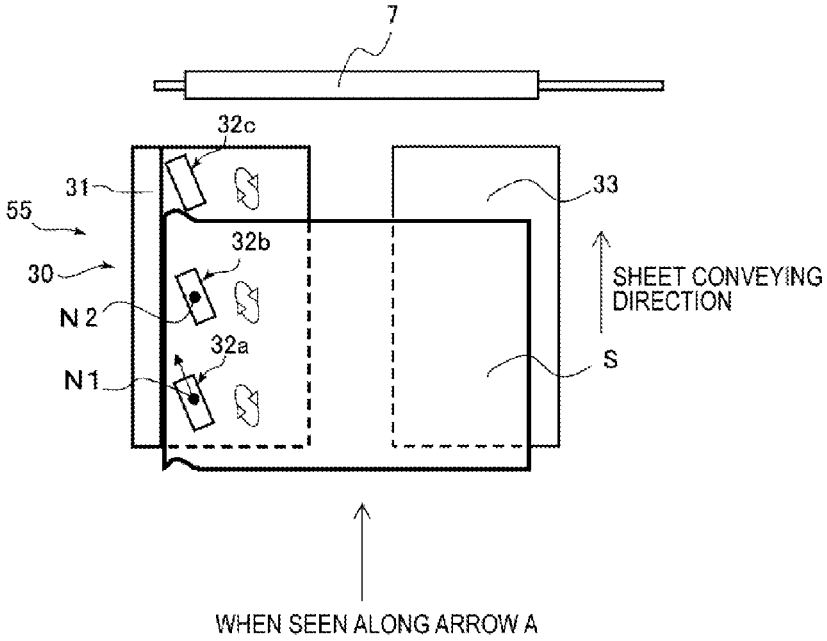

Then, the skew-feeding occurs in the sheet S which collides with the reference member 31 so that the leading end and the tail end thereof are warped due to a warpage difference $\Delta L$ between the leading end and the tail end illustrated in FIG. 11A. However, the sheet S slips at the nip N1 between the first pair of skew-conveying rollers 32*a* due to the stiffness as illustrated in FIG. 11B, whereby the sheet follows the shape of the reference member 31. Subsequently, the sheet S conveys while also slipping at the nip N2 of the second pair of skew-conveying rollers 32*b*, whereby the sheet is aligned by the collision with the reference member 31.

Figure 12:
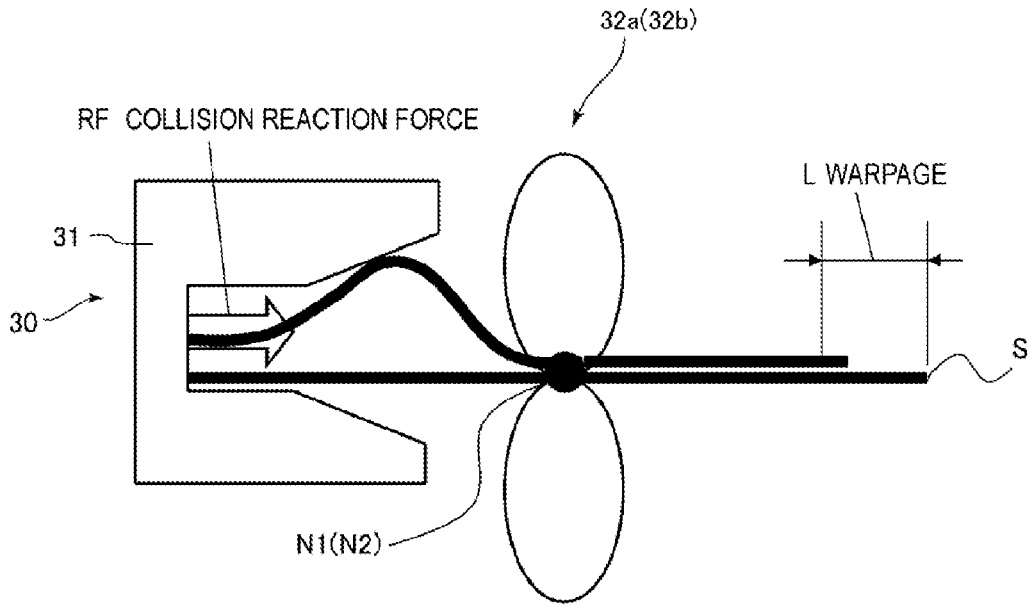
FIG. 12 is a third diagram illustrating the movement of the sheet when the skew-feeding correction is performed by the skew-feeding correcting apparatus.

Furthermore, FIG. 12 is a diagram when FIG. 11B is seen from the direction A. As illustrated in FIG. 12, when the sheet S may collide with the reference member 31, the sheet S slips at the nips N1 and N2 of the skew-conveying rollers due to the reaction force RF generated by the collision from the reference member 31, so that the warpage L in the collision direction is sequentially released. Accordingly, the skew-feeding of the sheet is corrected while sequentially solving the warpage difference ΔL.

On the other hand, as described above, the thin coated sheet is prevented from wounding around the fixing roller by conveying the sheet so that the fiber-orientation of the sheet is parallel to the sheet conveying direction. However, in this case, a gutter-shaped curl occurs when forming an image on both faces of the sheet, and hence the warpage in the collision direction is enlarged. In particular, in a case of the thin coated sheet having a basis weight which is less than 70 gsm, the influence of the gutter-shaped curl may not be ignored. Accordingly, there is a strong tendency that the sheet having an image formed on both faces (hereinafter, referred to as a double-sided sheet) is skew-fed with respect to the sheet having an image formed on one face (hereinafter, referred to as a single-sided sheet).

Therefore, in the embodiment, when correcting the skew-feeding of the double-sided sheet, the image position matching operation is performed on the front and rear faces by adding the skew-feeding correction amount estimated in advance so as to adjust the skew-feeding of the single-sided sheet. Furthermore, since the image position matching operation is performed on the front and rear faces, the reference member 31 is provided so as to be rotatable in the movable guide 30 as illustrated in FIG. 6. In addition, the reference member 31 is rotated by a cam 700 about a rotation center shaft 702 which is provided in the downstream side end portion in the sheet conveying direction, so that the rotation amount α of the reference member 31 is changed.

Figure 14:
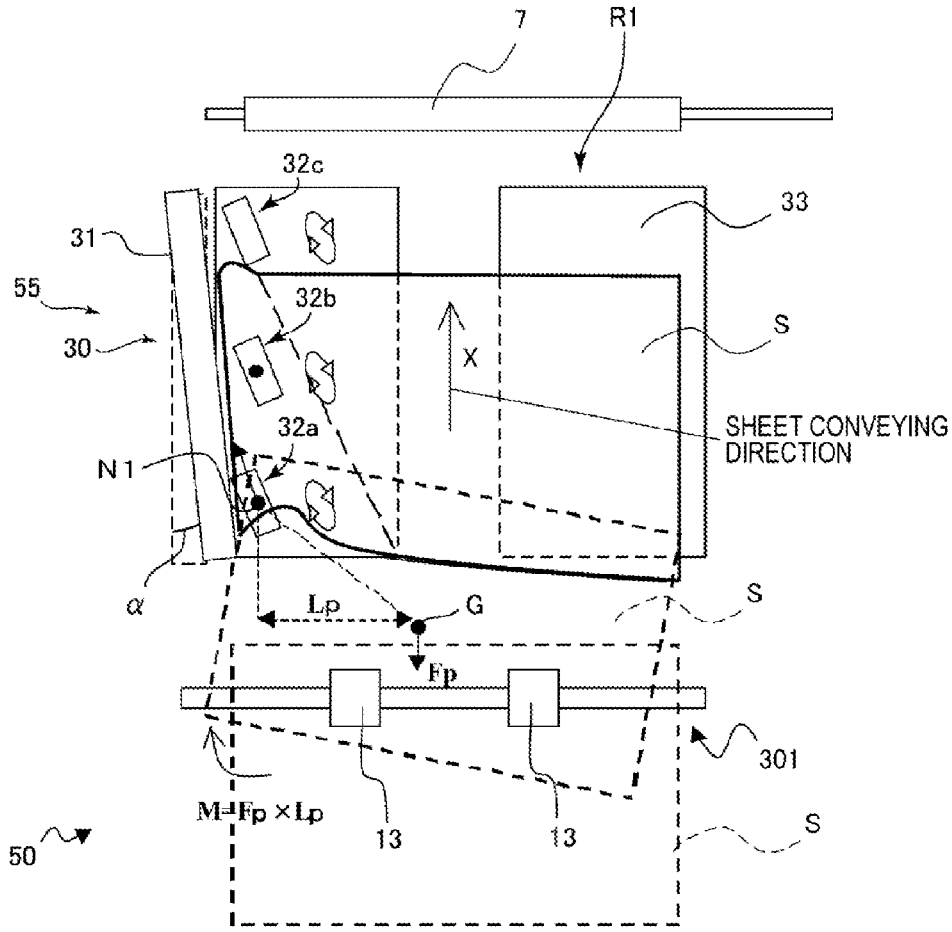
FIG. 14 is a diagram illustrating the movement of the sheet when the reference member rotates.

When the reference member 31 is rotated as illustrated in FIG. 14 in consideration of the skew-feeding caused by the gutter-shaped curl of the double-sided sheet in this way, the double-sided sheet having the gutter-shaped curl first collides with the upstream end in the sheet conveying direction of the reference member 31 which rotates toward the sheet (the center of the sheet conveying path). Next, the double-sided sheet is skew-conveyed by the pair of skew-conveying rollers 32*a* to 32*c* toward the reference member 31 while being skew-conveyed by the first pair of skew-conveying rollers 32*a*.

However, since the reference member 31 rotates toward the sheet at this time, the side end of the double-sided sheet does not collide with the reference member 31 even when the sheet is skew-conveyed. Then, since the side end of the sheet does not collide with the reference member 31 in this way, the side end position of the double-sided sheet is positioned near the sheet conveying path in relation to the side end position of the single-sided sheet. Here, since a difference between the side end position of the double-sided sheet and the side end position of the single-sided sheet is set by the gutter-shaped curl, the position of the image of the double-sided sheet in the width direction may match the position of the single-sided sheet in the width direction.

Figure 13A:
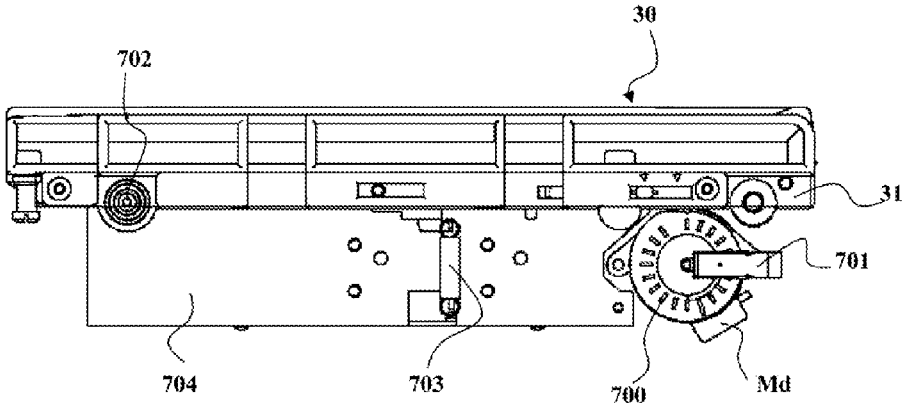
FIGS. 13A and 13B are diagrams illustrating a configuration which rotates a reference member of the skew-feeding correcting apparatus.
Figure 13B:
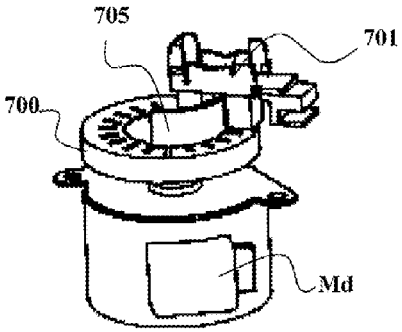

Furthermore, as illustrated in FIGS. 13A and 13B, the cam 700 is directly connected to the cam motor Md as a stepping motor which constitutes a driving portion rotating the reference member 31 along with the cam 700, and includes a flag 705 which detects the phase angle of the cam 700. Then, when the flag 705 shields the light of the photo interrupter 701 as illustrated in FIG. 13B, the controller 600 as the control portion detects that the cam 700 is present at the home position. Further, as illustrated in FIG. 13A, the reference member 31 is configured so as to normally abut the cam 700 by the pulling spring 703, and the controller 600 adjusts the rotation amount of the reference member 31 to the conveying portion by the rotation angle from the home position before the cam 700.

Here, the ingression amount (the rotation amount) λ of the cam 700 in a case of the double-sided sheet is set to an inequation of the double-sided sheet≥the single-sided sheet. Accordingly, for example, on the assumption that the rotation amount in a case of the double-sided sheet is indicated by α2 and the angle in a case of the single-sided sheet is indicated by α1, an equation of α2=α1+δ is established. δ indicates the correction amount which is set so that the skew-feeding correction of the second face matches the skew-feeding correction of the first face, and the correction amount δ may be adjusted by the user in response to the basis weight of the sheet. Furthermore, in the embodiment, the correction amount δ increases in response to the basis weight of the sheet.

Furthermore, the table (the setting value) of the correction amount δ is stored in the ROM 603 of the controller 600 illustrated in FIG. 9, and may be adjusted in response to the basis weight. Further, the user does not need to adjust the rotation amount α1 since a variation in the precision of the component involved with the skew-feeding adjustment for each apparatus is adjusted by using an automatic cam adjustment. Further, as illustrated in FIG. 6, the cam 700 may be adjusted in the pulse direction and the minus direction illustrated in FIG. 15A when the inclination direction in the direction opposite to the collision direction with respect to the sheet conveying direction x is set to the plus direction.

Next, the skew-feeding adjustment of the reference member 31 will be described. Here, in the embodiment, the user adjusts the rotation amount α of the reference member 31 for the skew-feeding adjustment in accordance with the test print output image as illustrated in FIG. 6. That is, the rotation amount α is adjusted by adjusting the rotation angle γ of the cam 700 and adjusting the cam ingression amount λ (mm). FIG. 15B illustrates the rotation angle γ, the cam ingression amount λ, and the skew-feeding adjustment amount (the rotation amount) α obtained by the input pulse to the cam motor Md of the cam 700 as the skew-feeding adjustment amount (mm) in the conversion into the size of A3.

Figure 15A:
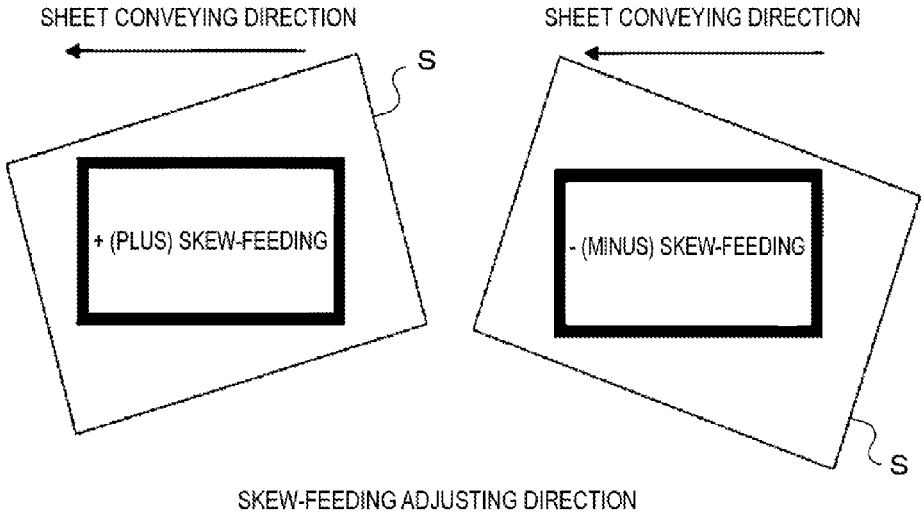

Furthermore, the table illustrated in FIG. 15B is a table of the rotation angle γ, the cam ingression amount λ, and the skew-feeding adjustment amount α when the sheet is present in the plus direction as a direction to perform the skew-feeding of the sheet S of which the leading end is inclined toward the reference member in relation to the tail end as illustrated in FIG. 15A. Further, a table (not illustrated) is used when the sheet is present in the minus direction as a direction to correct the skew-feeding of the sheet S of which the tail end is inclined toward the reference member in relation to the leading end. Then, when the reference member 31 is rotated based on the table upon forming an image on both faces of the sheet, the sheet may be further displaced to the center side of the sheet conveying path compared to the case of forming an image on a single face of the sheet.

Figure 16:
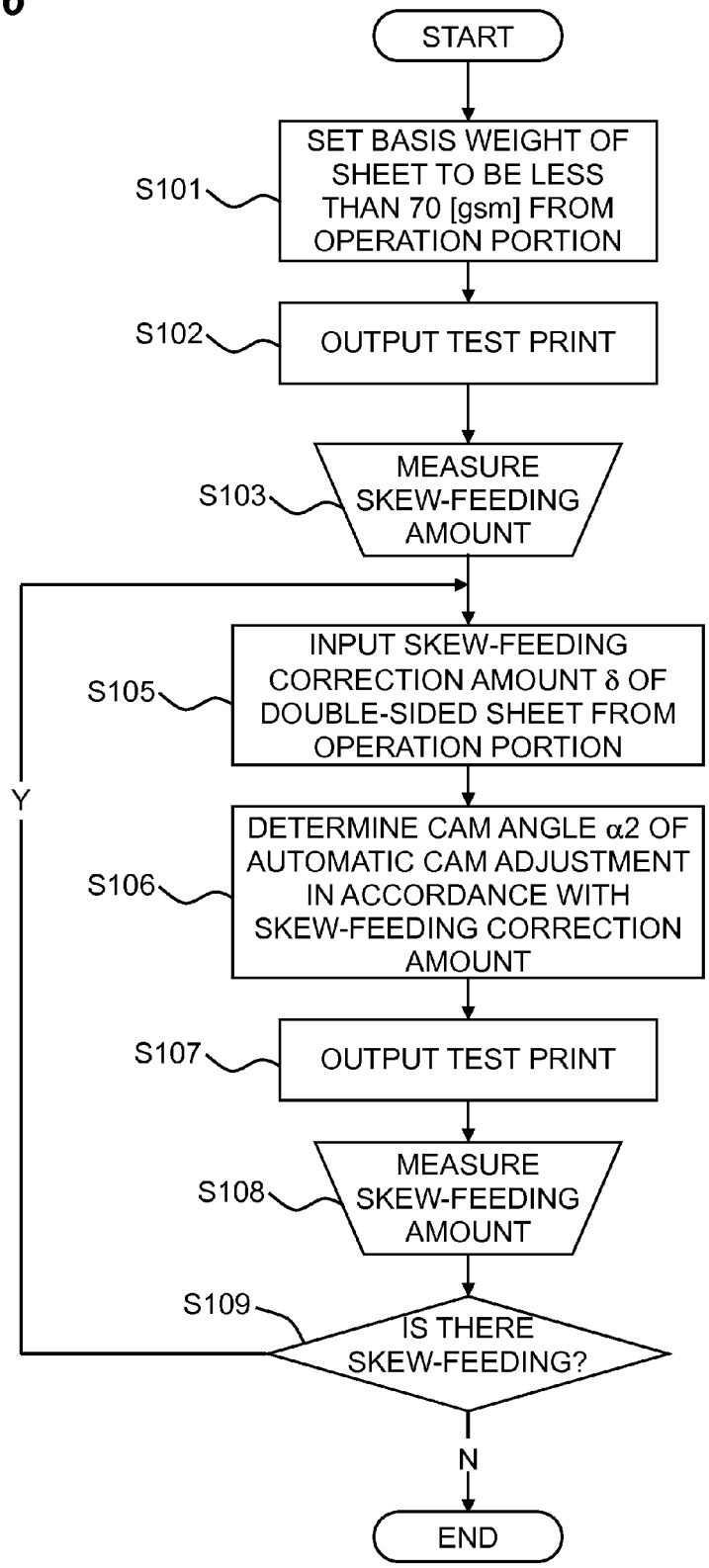
FIG. 16 is a flowchart illustrating an operation of adjusting the skew-feeding of a double-sided sheet in the skew-feeding correcting apparatus.

Next, an operation of allowing the user to adjust the skew-feeding of the double-sided sheet in response to the test print output image in a case of the thin coated sheet having a basis weight which is less than 70 gsm according to the embodiment will be described by the flowchart illustrated in FIG. 16.

First, the basis weight (which is less than 70 gsm) of the sheet is input (set) from the operation portion 412 as the setting portion (S101). Subsequently, the user outputs a test print as a sheet having an image formed thereon for a test (S102), and measures a difference in the skew-feeding amount of the double-sided sheet with respect to the single-sided sheet from the actually output test print image (S103). Next, the skew-feeding correction amount δ for correcting the skew-feeding of the double-sided sheet is input from the operation portion as the correction portion (S105), and the rotation amount ($\alpha 2=\alpha 1+\delta$) for correcting the skew-feeding of the double-sided sheet is determined (S106). Then, the skew-feeding adjustment using the automatic cam adjustment is performed by adjusting the input pulse to the cam motor Md in response to the rotation amount corrected in this way.

Next, the user outputs a test print as a confirming operation (S107), measures the skew-feeding amount (S108), and repeats the skew-feeding adjustment of S105 to S108 when the skew-feeding adjustment of the double-sided sheet is not sufficient, that is, the skew-feeding occurs in the double-sided sheet (Y in S109). Further, when the adjustment is completed, that is, the skew-feeding does not occur in the double-sided sheet (N in S109), the skew-feeding adjustment ends.

Figure 17:
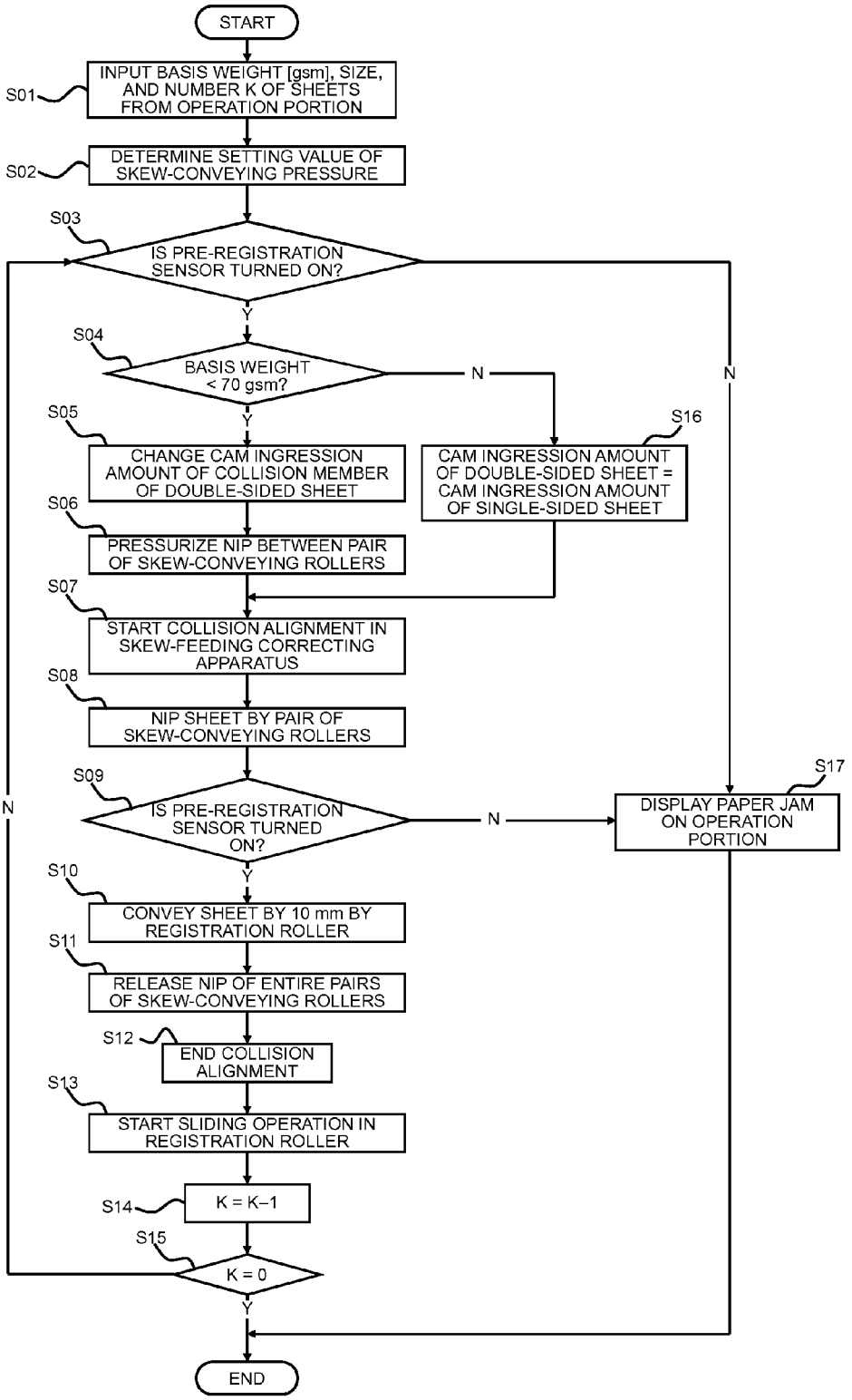
FIG. 17 is a flowchart illustrating an operation of correcting the skew-feeding of the double-sided sheet in the skew-feeding correcting apparatus.
Figure 18A:
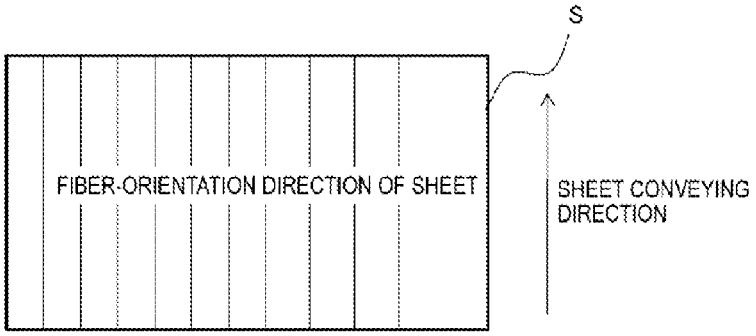
FIG. 18A PRIOR ART
FIGS. 18A and 18B are diagrams illustrating a state of a thin coated sheet in a skew-feeding correcting portion of the related art.
Figure 18B:
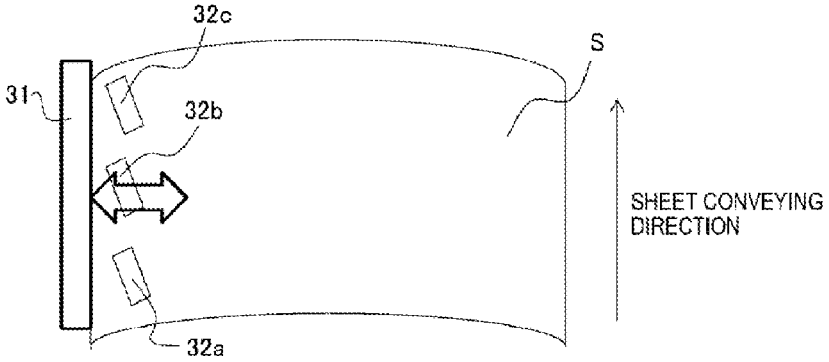
FIG. 18B PRIOR ART

Next, an operation of correcting the skew-feeding of the double-sided sheet according to the embodiment after performing the skew-feeding adjustment of the double-sided sheet will be described by using the flowchart illustrated in FIG. 17. First, the basis weight (gsm), the size, and the number K of sheets to be printed are input from the operation portion as the input portion (S01). Accordingly, the controller 600 determines the setting value of the nip pressure (the skew-conveying pressure) of the pair of skew-conveying rollers in response to the basis weight or the size of the sheet (S02).

Subsequently, when the sheet S reaches the conveying roller apparatus 50 as illustrated in FIG. 3A with the start of the passing of the sheet and the pre-registration sensor P detects the leading end of the sheet to be turned on (Y in S03), the pre-registration driving motor Mp is temporarily stopped and the sheet-to-sheet time is adjusted. Furthermore, when the pre-registration sensor P does not detect the leading end of the sheet (N in S03), a paper jam (a delaying jam) is displayed on the operation portion (S17) and the process ends.

Next, when the sheet basis weight is less than 70 gsm (Y in S04) by determining whether the sheet basis weight is less than 70 gsm (S04), the cam ingression amount of the reference member 31 is changed (S05), and is set to the cam ingression amount which is determined by the skew-feeding adjustment obtained from the output of the test print of FIGS. 15A and 15B. Next, the pre-registration driving motor Mp is re-started, and the double-sided sheet is conveyed to the skew-feeding correcting apparatus 55. Then, at the timing at which the pre-registration sensor P detects the leading end of the sheet S (ON) and the leading end of the sheet does not reach the pair of skew-conveying rollers yet, the driven rollers 331*a* to 331*c* abut the driving rollers 332*a* to 332*c*.

Subsequently, the nip between the pair of skew-conveying rollers is pressurized to the predetermined skew-conveying pressure setting value (S06). Here, the pressurizing operations may be performed at the same timing and may be sequentially performed from the upstream side in the conveying direction. Furthermore, even in the double-sided sheet, when the sheet basis weight is 70 gsm or more (N in S04), the ingression amount of the cam is not changed while the cam ingression amount of the double-sided sheet is set to the cam ingression amount as in the single-sided sheet. That is, the cam ingression amount of the double-sided sheet is made to be equal to the cam ingression amount of the single-sided sheet (S16).

Next, after the sheet is conveyed to the skew-feeding correcting apparatus 55 as illustrated in FIG. 3B, the driven roller 14 of the conveying roller apparatus 50 releases the nip and the alignment starts by the collision in the skew-feeding correcting apparatus 55 (S07). Subsequently, as illustrated in FIG. 3C, the sheet S is nipped between the pair of skew-conveying rollers 32*a* to 32*c* (S08). Next, when the pre-registration sensor Q is turned on (Y in S09) after waiting for the state until the pre-registration sensor Q is turned on by detecting the leading end of the sheet (S09), the sheet S which undergoes the correction of the skew-feeding by the skew-feeding correcting apparatus 55 is nipped by the registration roller 7 and is conveyed by 10 mm (S10). Then, when the sheet is conveyed by 10 mm in this way, all nips between the pair of skew-conveying rollers 32*a* to 32*c* are released (S11), and the alignment by the collision ends (S12).

Next, the transverse sliding operation of the registration roller 7 starts (S13). Furthermore, the nip releasing timing of the pair of skew-conveying rollers 32*a* to 32*c* is a timing in which the time obtained by dividing the distance from the pre-registration sensor Q to the registration roller 7 by the skew-conveying speed is added to the time necessary for conveying the sheet by the registration roller 7 by 10 mm from the timing at which the pre-registration sensor Q is turned on.

Further, when the pre-registration sensor Q does not detect the leading end of the sheet S (the sensor is not turned on) (N in S09), the paper jam (the delaying jam) is displayed in the operation portion (S17), and the process ends. Subsequently, a sheet passing counter counts the equation of K=K−1 (S14), and determines whether K=0 (S15). Then, when the equation of K=0 is not established (N in S15), that is, the sheet is not the final sheet, the conveying roller nip NPr is pressurized again at the timing at which the sheet alignment in the pair of skew-conveying rollers ends and the continuous passing of the sheet is performed. Further, when the sheet passing counter becomes the equation of K=0 (Y in S15), that is, the sheet becomes the final double-sided sheet, the skew-feeding correcting operation ends.

As described above, in the embodiment, the reference member 31 is inclined in a direction opposite to the collision direction, that is, a direction toward the center side in the sheet conveying path in a manner such that the skew-feeding correction amount which is estimated in advance is added to the skew-feeding adjustment amount of the first face and the cam 700 is rotated. That is, in the embodiment, when forming an image on both faces of the sheet, the reference member 31 is further rotated toward the sheet conveying path as a direction opposite to the skew-conveying direction by the pair of skew-conveying rollers 32*a* to 32*c* compared to the case of forming an image on one face of the sheet.

Accordingly, when forming an image on both faces of the sheet, the sheet is displaced to the center side of the sheet conveying path compared to the case of forming an image on one face of the sheet. As a result, even in a sheet having a low stiffness such as a coated sheet which is less than 70 gsm, it is possible to suppress the displacement of the image forming positions of both faces of the sheet in the width direction.

Furthermore, according to the configuration of the embodiment, even when a thin sheet and a thick sheet exist, when the rotation amount $\alpha 2$ of the second face is set for each basis weight of the sheet, the registration precision in front and rear faces in the case where the thick sheet and the thin sheet exist also improves. That is, it is possible to improve the registration precision in front and rear faces in a case where various kinds of sheets exist by performing the skew-feeding adjustment reflecting a difference in the skew-feeding amount of the second face in response to the type of the sheet. Furthermore, a case has been described so far in which the skew-feeding correcting apparatus 55 according to the side registration type is provided in the sheet conveying path R1, but the invention is not limited thereto. For example, the skew-feeding correcting apparatus may be provided in the re-conveying path R.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-243446, filed Nov. 7, 2011, which is hereby incorporated by reference herein in its entirety.

What is claimed is:

1. An image forming apparatus which forms an image on a first face of a sheet by an image forming portion, and after reversing, forming an image on a second face of the sheet, the image forming apparatus comprising:

a sheet conveying path which guides the sheet to the image forming portion so that a center of the sheet in a width direction is positioned over a center of the sheet conveying path in the width direction;

a reference member which is disposed along a sheet conveying direction of the sheet conveying path, said reference member provided so as to be rotatable about a downstream end portion of the reference member in the sheet conveying direction;

a plurality of skew-conveying rollers which are arranged in the sheet conveying path along the sheet conveying direction and which obliquely convey the sheet toward the reference member so as to abut one side end of the sheet against the reference member so as to regulate a position of the sheet in the width direction;

a driving portion which rotates the reference member; and a control portion which, compares a basis weight of the sheet to a predetermined value and when the sheet basis weight of the conveyed sheet is less than the predetermined value, controls the driving portion to rotate the reference member so that an upstream side of the reference member comes closer to the center of the sheet conveying path when regulating the sheet to form the image on the second face than does the driving portion rotate the reference member when an image is formed on the first face.

2. The image forming apparatus according to claim 1, further comprising:

an input portion which inputs a basis weight of the sheet, wherein the control portion controls the driving portion so as to rotate the reference member from the position at which the reference member regulates the sheet for formation of the image on the first face to the position at which the reference member regulates the sheet for formation of the image on the second face when the basis weight of the sheet input from the input portion is smaller than the predetermined value.

3. The image forming apparatus according to claim 1, wherein the driving portion includes a cam which abuts the reference member and a pulse motor which rotates the cam, and the control portion adjusts a rotation amount of the reference member by a rotation angle of the cam caused by the pulse motor.

4. The image forming apparatus according to claim 3, wherein a position where the cam abuts the reference member is set on the upstream side in the sheet conveying direction.

* * * * *